US008836721B1

(12) United States Patent
Wichary et al.

(10) Patent No.: US 8,836,721 B1
(45) Date of Patent: Sep. 16, 2014

(54) VISUALIZING ALTERNATE INFORMATION

(75) Inventors: Marcin Kazimierz Wichary, San Francisco, CA (US); Kristopher Hom, San Jose, CA (US)

(73) Assignee: Google Inc., Mountain View, CA (US)

( * ) Notice: Subject to any disclaimer, the term of this patent is extended or adjusted under 35 U.S.C. 154(b) by 204 days.

(21) Appl. No.: 13/417,144

(22) Filed: Mar. 9, 2012

(51) Int. Cl.
*G09G 5/00* (2006.01)

(52) U.S. Cl.
USPC ..... 345/629; 345/632; 345/634; 345/641; 345/671; 701/428; 701/431; 701/432; 701/455; 701/459

(58) Field of Classification Search
CPC ..... G09G 5/14; G09G 2340/10; G09G 2340/125; G06T 11/60; H04N 5/44504
USPC ..... 345/629, 632, 634, 641, 671; 701/428, 701/431, 432, 455, 459
See application file for complete search history.

(56) References Cited

U.S. PATENT DOCUMENTS 5,689,287 A * 11/1997 Mackinlay et al. ..... 345/427
7,496,484 B2 * 2/2009 Agrawala et al. ..... 703/2
7,702,454 B2 * 4/2010 Nesbitt ..... 701/426
8,493,408 B2 * 7/2013 Williamson et al. ..... 345/629
2003/0006995 A1 * 1/2003 Smith et al. ..... 345/671
2005/0177304 A1 * 8/2005 Tu ..... 701/211
2007/0097109 A1 * 5/2007 Shoemaker et al. ..... 345/418
2009/0219281 A1 * 9/2009 Maillot ..... 345/419
2010/0045702 A1 * 2/2010 Doyle et al. ..... 345/641
2010/0079495 A1 * 4/2010 Ubillos et al. ..... 345/660

OTHER PUBLICATIONS

Photo Tour: Apple Aperture 1.5—CNET Reviews, Apr. 6, 2007 (Retrieved Mar. 26, 2012), from http://reviews.cnet.com/2300-3513_7-6568431-3.html?s=0&o=6568431&tag=mncol;page.

* cited by examiner

*Primary Examiner* — Xiao Wu
*Assistant Examiner* — Todd Buttram
(74) *Attorney, Agent, or Firm* — McDermott Will & Emery LLP

(57) ABSTRACT

The subject matter of this specification can be implemented in, among other things, a method that includes providing a first image from a server system to a client computing device for display and providing a second image from the server system to the client computing device for display. The method also includes providing instructions from the server system to the client computing device for displaying a window over the first image that displays a portion of the second image within the window, where the portion of the second image displayed within the window corresponds to a position of the window over the first image, and where the portions of the second image include one or more rectangular shapes to approximate a curved shape.

12 Claims, 5 Drawing Sheets

VISUALIZING ALTERNATE INFORMATION

TECHNICAL FIELD

This instant specification relates to visualizing information.

BACKGROUND

Websites and other applications often display images of various sorts (e.g. logos, maps, and other pictorial representations). Users of such websites and applications may desire to obtain alternate information about portions of the displayed images. For example, a user may want to obtain more details or magnified views of an underlying image or geographical map data for an underlying street map image. Different websites, browser versions, browser types and applications have varying capabilities for displaying alternate information about underlying images.

Thus, it may be desirable to provide a way for displaying alternate information in a consistent manner across varying websites, browser versions, browser types, and applications.

SUMMARY

The disclosed subject matter relates to a machine-implemented method for visualizing alternate information. The method includes providing a first image from a server system to a client computing device for display and providing a second image from the server system to the client computing device for display. The method also includes providing instructions from the server system to the client computing device for displaying a window over the first image that displays a portion of the second image within the window. The portion of the second image displayed within the window corresponds to a position of the window over the first image. In certain aspects, the instructions for displaying a portion of the second image within the window include instructions for displaying one or more rectangular shapes, where the edges of the shapes approximate a curved shape. In some aspects, the instructions for displaying a portion of the second image within the window further includes instructions for displaying a border that obscures edges of the multiple rectangular shapes that approximate the curved shape.

The disclosed subject matter further relates to a system. The system includes one or more processors. The system also includes a memory, the memory having instructions which, when executed by the one or more processors, cause the one or more processors to implement a method for visualizing alternate information. The instructions include code for providing a first image from a server system to a client computing device for display. The instructions also include code for receiving user input from the client computing device, where the user input provides information about a position of the window corresponding to a portion of the first image. The instructions further include code for providing instructions from the server system to the client computing device for displaying at least a portion of a second image within the window over the first image. In some aspects, the instructions for displaying at least a portion of a second image within the window include instructions for displaying one or more rectangular shapes to approximate a curved shape.

The disclosed subject matter further relates to a machine-readable medium. The machine-readable medium includes instructions that when executed by a computer, cause the computer to implement a method for visualizing alternate information. The instructions include code for providing a first image from a server system to a client computing device for display and code for providing a second image from the server system to the client computing device for display. The instructions also include code for providing instructions from the server system to the client computing device for displaying a window over the first image that displays a portion of the second image within the window. In various aspects, the instructions for displaying a portion of the second image within the window include instructions for displaying those portions of the second image that correspond to a position of the window over the first image. In certain aspects, the instructions for displaying the window further include instructions for displaying a border to obscure edges of one or more rectangular shapes displayed in the window. In one aspect the one or more rectangular shapes approximate a curved shape of at least a portion of the second image.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

DETAILED DESCRIPTION

Figure 1:
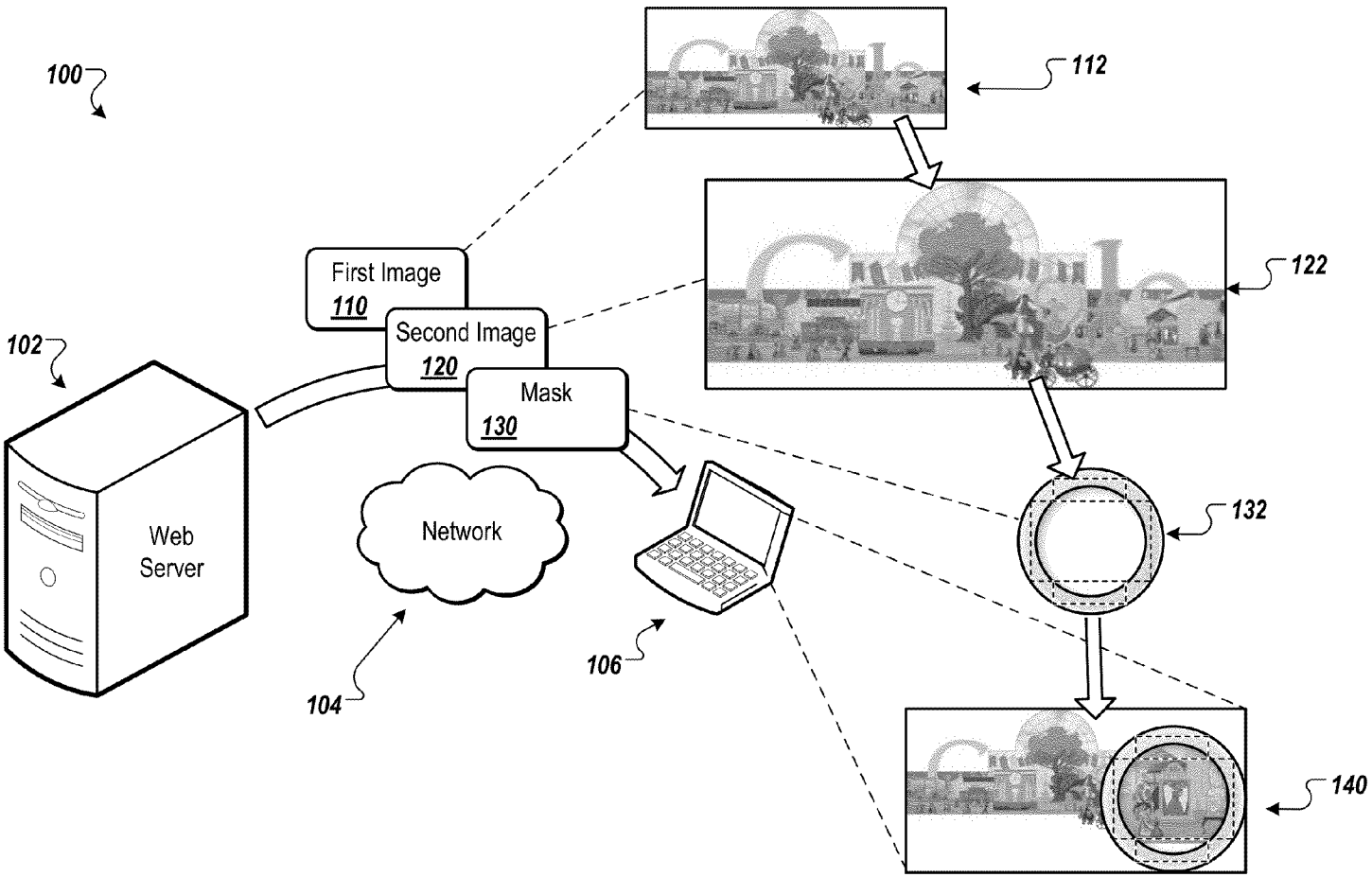
FIG. 1 is a schematic diagram that shows an example of a system for visualizing alternate information.

This document describes systems and techniques for visualizing alternate information. The system provides one or more images of a base representation, one or more images of alternate information correlating to the base representation, and a graphical user interface (GUI) element, such as a window or mask shape, to client computing devices. As a user moves the provided GUI element over portions of the base representation, the window is updated with the corresponding image data of alternate information.

For example, a user may be viewing a webpage with a picture of a road map for a region in the world. The user is provided with a mask or a window that can be moved over the map. As the user moves the mask over the map, the window gets updated with alternate information about the portion of the map encompassed in the window. Alternate information may be other types of maps (e.g. showing a portion of an elevation map on top of a satellite road map of a region, etc.). In another example, the user may move a GUI window element, representing a magnifying glass, over a base image causing the contents of the magnifying glass window to be updated with magnified image data corresponding to that portion of the base image over which the magnifying glass window is positioned.

In certain aspects, a visualizing alternate information system will update a mask with alternate information by sending to a client a base image, an alternate image, a mask shape, and instructions on how to render portions of the alternate image as a user moves the mask shape over the base image. In one aspect the updating of a curved mask shape will be achieved by updating multiple rectangular areas (with portions of alternate image data corresponding to the rectangles) within the mask window to approximate a curved window shape. For example, updating the contents of a magnifying glass mask may be achieved by providing three rectangles with portions of a magnified image. The three rectangles may be displayed adjacent to each other to approximate a circular shape image. The rectangles may be of variable sizes. In one aspect, the updating of a curved mask shape will be further achieved by displaying a border that obscures edges of multiple rectangular shapes that help approximate a curved shape. One advantage, of approximating image data using rectangles for display in a curved window, is that browsers and applications that do not support displaying of information in curved masks or GUI windows may support such functionality by using the approximation technique described here.

Using three rectangles and a curved border surrounding the rectangles is illustrative. One skilled in the art can appreciate a host of combinations for approximating curved image data. For example, a circular image may be broken into a plurality of polygons of various shapes and sizes, perhaps just one square with a circular border to approximate a circular image. The circular border may be of any width, color, etc. without deviating from the scope of this disclosure. Also, an obscuring border may be of any other shape suitable to displaying alternate information composed of various polygon combinations without deviating from the scope of this disclosure.

FIG. 1 is a schematic diagram that shows an example of a system 100 for visualizing alternate information. FIG. 1 depicts a web server 102, in communication with a client computing device 106 via a network 104. The system shows web server 102 providing a first image 110, a second image 120 and a mask 130 to a client computing device 106. The contents of first image 110 are further blown up into a rectangular box 112. Box 112 shows the graphics associated with the first image 110 (the image depicts a fair or carnival with a company logo in the background). Contents of the second image 120 are shown in the rectangular box 122. Box 122 shows that the second image 120 is a magnified image of the first image 110. Mask 130 is further detailed in circular mask 132 (suggesting a magnifying glass). Circular mask 132 is shown to be made up of three rectangles and a circular border to illustrate how the underlying information will be displayed in the circular mask.

Window 140 shows the results of process 100 as a user moves a circular mask over a base image to display alternate information in a curved mask. Window 140 depicts a base image corresponding to the first image 110, a curved mask corresponding to circular mask 130, and portions of a second image 120 shown in the inside portion of the circular mask. Portions of the second image 120 that are shown in the mask shape 130 are those portions of the second image 120 corresponding to portions of the first image 110, determined by the placement of the circular mask 130 over the first image 110. In particular, window 140 further depicts that the image or information displayed inside of the circular mask 110 is made up of three rectangles and surrounded by a circular border. Process 100 illustrates one way in which circular images may be approximated by using non-circular images (e.g., the three rectangles) and a circular border.

FIG. 1 is illustrative and one skilled in the art can appreciate that a system for visualizing alternate information may be designed in many variations without deviating from the scope of this disclosure. Web server 102 may be implemented as a single machine with a single processor, a multi-processor machine, or a server farm including multiple machines with multiple processors. Network 104 may include the Internet, an intranet, a local area network, a wide area network, a wired network, a wireless network, or a virtual private network (VPN).

The client computing device 106 may be a laptop computer, a desktop computer, a mobile phone, a personal digital assistant (PDA), a tablet computer, a netbook, a television with one or more processors embedded therein or coupled thereto, a physical machine, or a virtual machine. The client computing device 106 may include one or more of a keyboard, a mouse, a display, or a touch screen. The client computing device 106 may also include a web browser configured to display webpages. The web browser may be configured to provide for display of alternate visual information, for example, by accessing a webpage for viewing alternate information for a base image. Alternatively, the client computing device 106 may include an application (e.g., a mobile phone or tablet computer application) for visualizing alternate information. While only one client computing device 106 is illustrated in FIG. 1, the subject technology may be implemented in conjunction with one or more client computing devices 106.

Figure 2:
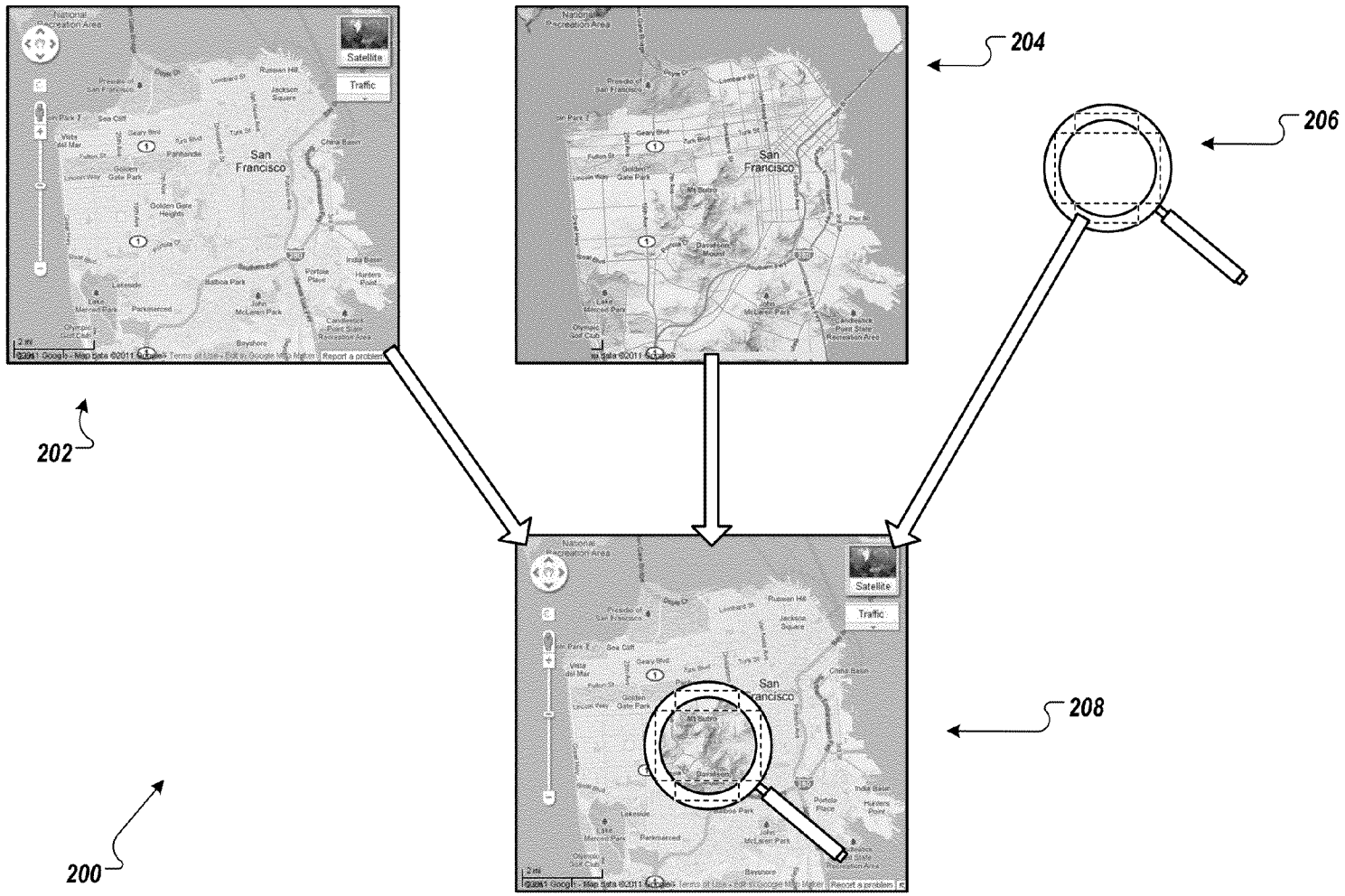
FIG. 2 illustrates a system for visualizing alternate information.

FIG. 2 illustrates a system for visualizing alternate information. It depicts a system 200 including a base image 202 of road map data, an alternate image 204 of terrain map data, a magnifying glass icon 206, and a box 208 depicting the results of moving the magnifying glass icon 206 over the base image 202 to display alternate image data 204. Window 208 shows that the interior of the magnifying glass 206 is updated with portions of alternate image 204 corresponding to portions of the base image 202, as determined by the location of the magnifying glass icon 206 over the base image 202. Portions of alternate image 204 of terrain map data as shown in the magnifying glass icon of window 208 are shown to be composed of three rectangles and are bordered by the circular shape of the magnifying glass mask. The three rectangles and the circular border may serve to approximate a circular image.

Figure 3:
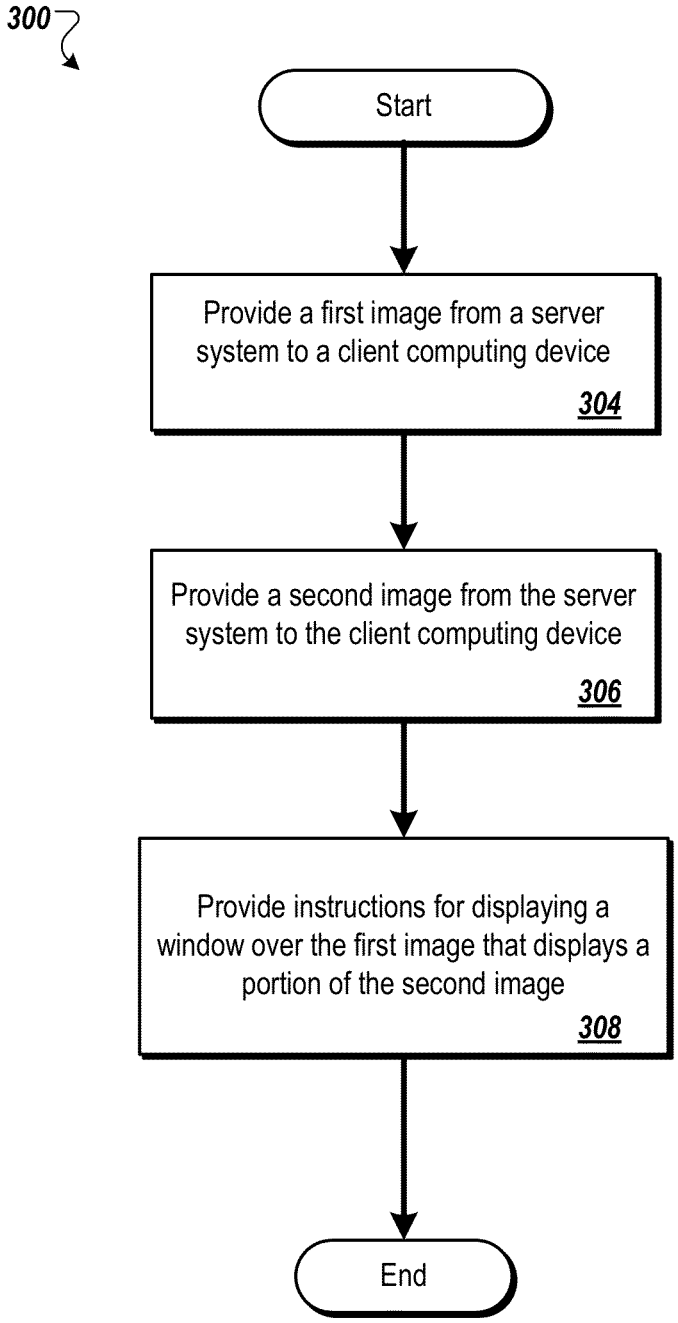
FIG. 3 is a flow chart that shows an example of a process for visualizing alternate information.

FIG. 3 is flow chart that shows an example of a process 300 for visualizing alternate information. The process 300 may be performed, for example, by a system such as the system 100 and the graphical user interface 200. For clarity of presentation, the description that follows uses the system 100 and the graphical user interface 200 as examples for describing the process 300. However, another system, or combination of systems, may be used to perform the process 300.

Process 300 of FIG. 3 may start by for example a user of a client computing device (e.g., client computing device 102 of FIG. 1) visiting a web page in a browser for visualizing alternate information or by visiting a maps application. A web server (e.g., web server 102 of FIG. 1) then provides a first image to a client computing device in step 304. In step 306 the server provides a second image to a client computing device. The second image provided in step 306 contains alternate information corresponding to the first image provided in step 304. For example, the alternate information may be a magnified image of the first image, it may be a terrain map of a road map, or it may be any other alternate information correlating to the first image.

In step 308 of FIG. 3, a server provides instructions for displaying a window over the first image that displays a portion of the second image in the window. For example, the window may be a GUI element, such as a circular mask, that a user can position over the first image in a user interface at the client computing device. The circular mask may then be updated with corresponding data from a second image, received in step 306, that corresponds to portions of the first image received in step 304 based on the position of the GUI element received in step 308.

First and second images may be portions of a larger image or an entire image. The first and second images may be provided as one file, a plurality of files, or streamed bytes, a database object, a blob, as one or more .gif files, as one or more .jpeg files, or any other suitable manner in which image, textual, audio, etc. data can be supplied by a server to a client computing device. The second image may correspond to a host of possible alternate information, corresponding to the first image, e.g., information about magnification of the first image, information about another type of map than the map in the first image, etc. First and second images may be provided as a set of images rather than one image for each image.

Steps 304, 306, and 308 may either be performed sequentially or simultaneously or partially sequentially and partially simultaneously without deviating from the scope of this disclosure. The steps may be performed in the order illustrated or in any other order combination. Instructions for steps 304, 306, and 308 may be sent by a server to a client device, e.g., in the form of either HTML or HTML/JavaScript combination. The languages discussed are exemplary and one skilled in the art can appreciate this disclosure being implemented in a host of programming languages.

In one aspect, steps 304, 306 and 308 may be performed simultaneously by a server upon the process 300 starting. For example, upon a user loading a webpage in a browser at a client computing device (e.g., component 106 of FIG. 1), a server (e.g., component 102 of FIG. 1) may provide information for all three of the steps 304, 306, and 308 simultaneously to the client computing device. In another aspect, instructions for steps 304, 306, and 308 may be provided at different times of process 300.

The instructions provided for process 300 may be a combination of HTML and JavaScript. The JavaScript may have the server rules and instructions on what to do as a user moves a shape or mask over portions of a first image. JavaScript instructions may include instructions for mapping portions of a second image corresponding to the location of the mask over a first image, instructions for creating the one or more polygons or rectangles of the mapped portions of the second image in order to approximate a curved shape (e.g., take the mapped information for the second image as the rectangular cuts of a region of the second image), or instructions for displaying the rectangles at a location that maps to the interior of the mask shape. If the mask shape is circular, the border of the circular mask may also facilitate in obscuring the edges of polygonal shapes to approximate a curve.

Figure 4:
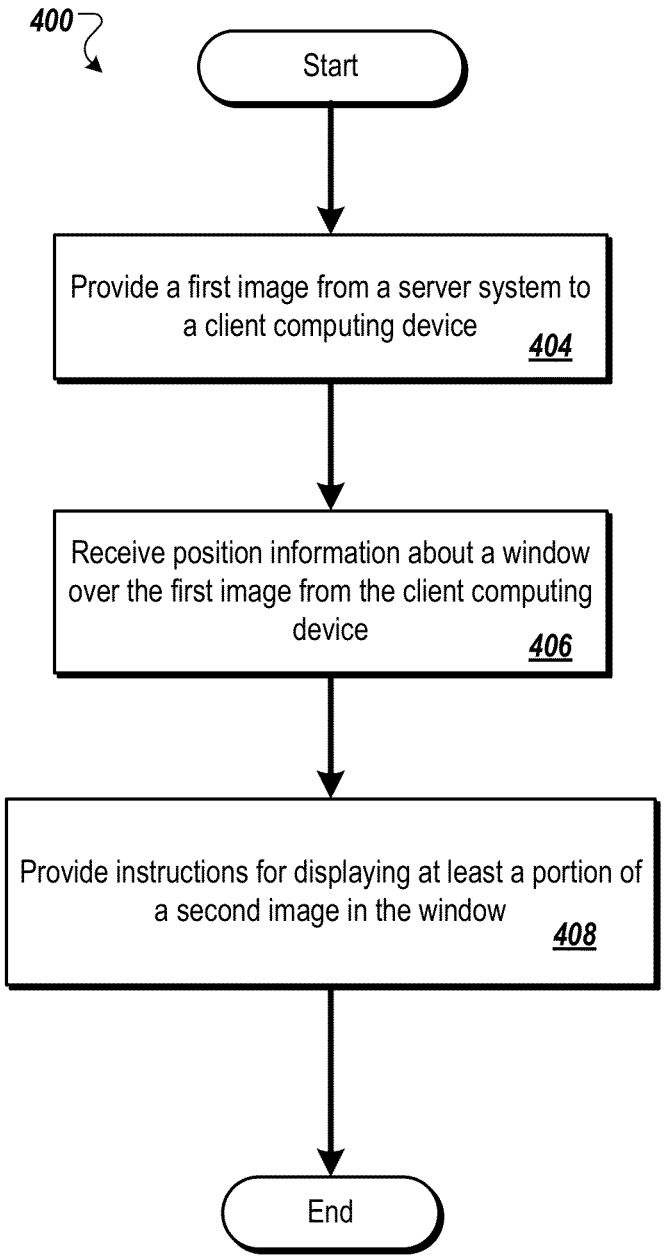
FIG. 4 is a flow chart that shows another example of a process for visualizing alternate information.

FIG. 4 is flow chart that shows an example of a process 400 for visualizing alternate information. The process 400 may be performed, for example, by a system such as the system 100 and the graphical user interface 200. For clarity of presentation, the description that follows uses the system 100 and the graphical user interface 200 as examples for describing the process 400. However, another system, or combination of systems, may be used to perform the process 400.

Process 400 of FIG. 4 starts by for example a user of a client computing device (e.g., client computing device 102 of FIG. 1) visiting a web page in a browser for visualizing alternate information or by visiting a maps application. A web server (e.g., web server 102 of FIG. 1) then provides a first image to a client computing device in step 404. In step 406 the server receives position information about a window or mask overlaying a portion of the first image from the client computing device. The received position information may provide information about the location of the window in relation to the first image, and information about the portions of the first image that the window is overlaying. Such received information may be used by the server for providing instructions in step 408.

In step 408, the server provides instructions for displaying at least a portion of a second image in the window or mask overlaying the first image. Step 408 may be performed in response to the receiving of position information as described for step 406. As discussed above for step 406, the server may receive information about the location of the window and information about portions of the first image that the window is corresponding in step 406. The server may then use the received information in step 406, to map at least a portion of a second image, that corresponds to the portion of the first image over which the mask is located. The server may provide all or only portions of the second image at step 408 to the client computing device. In the case where a server provides an entire second image at step 408, the server may further provide information as to which portions of the second image to display in the window.

Instructions at step 408 may include taking one or more polygonal cuts of a second image to display in a circular window. In one aspect, the server may prepare one or more polygonal cuts of a second image and send only those for display in the window overlaying the first image. In one aspect, the instructions provided at step 408 may include instructions for displaying one or more rectangular shapes (containing portions of image data from the second image), to approximate a curved shape. The instructions at step 408 may further include displaying of a border that obscures edges of the multiple polygonal shapes or image cuts displayed to approximate a curved shape or image data displayed in the curved shape.

This disclosure discusses various examples of systems for visualizing alternate information. Although, the examples have specified a first image and a second image as image data, one skilled in the art can appreciate that an alternate information system can be designed based on this disclosure that provides alternate information, other than visual or image data. For example, the second image could instead be second audio or text data that provides alternate information in the form of sound or text, corresponding to the mask shape overlaying a portion of the first image (e.g., a user moves a round mask over a portion of the map, and the mask is updated with textual or audio traffic information corresponding to that portion of the map which corresponds to the location of the mask shape). As such, the present disclosure is not limited to alternate data in the form of image data.

Figure 5:
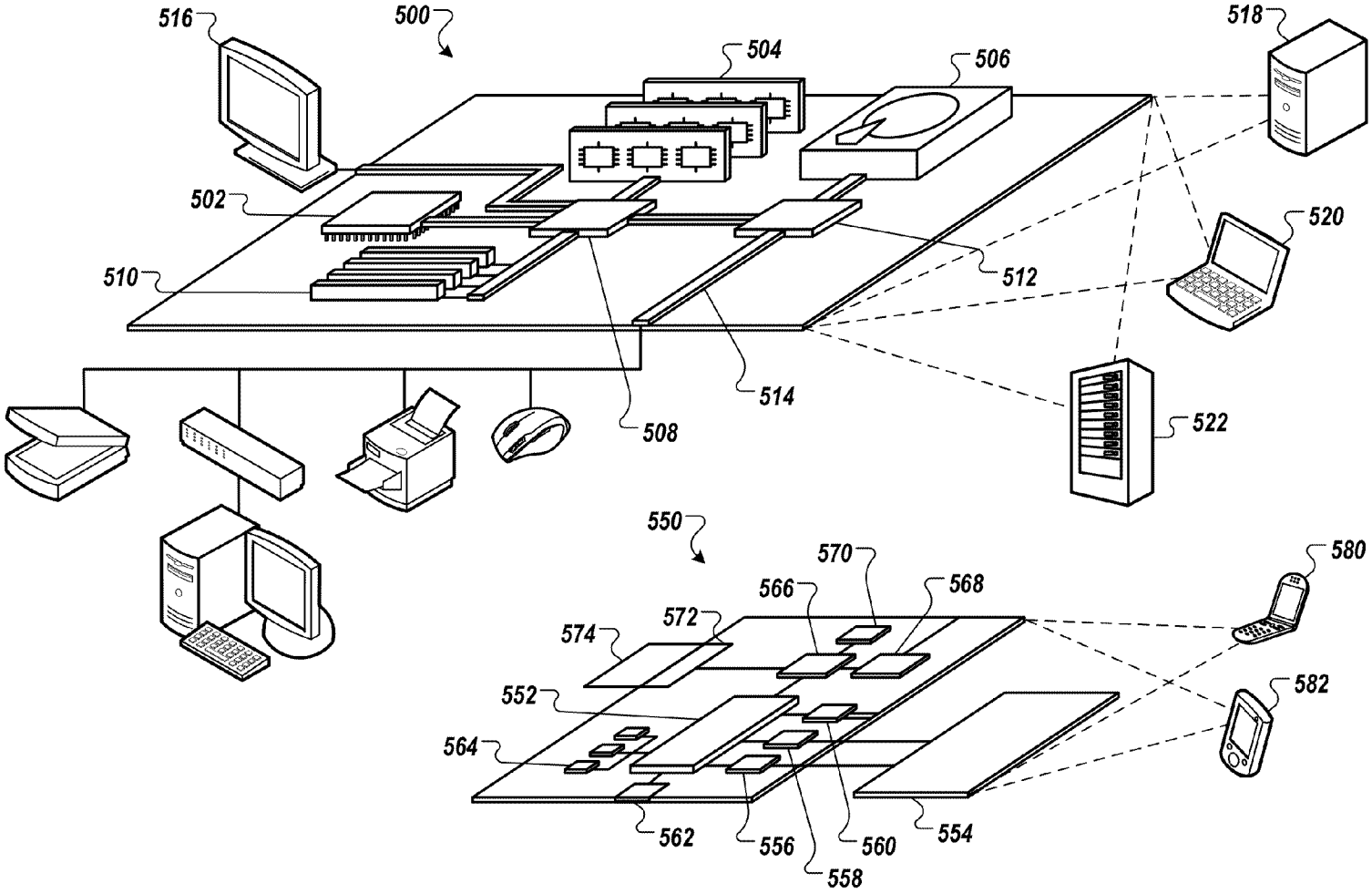
FIG. 5 is a schematic diagram that shows an example of a computing device and a mobile computing device.

FIG. 5 is a schematic diagram that shows an example of a computing device 500 and an example of a mobile computing device that can be used to implement the systems and techniques described here. The computing device 500 is intended to represent various forms of digital computers, such as laptops, desktops, workstations, personal digital assistants, servers, blade servers, mainframes, and other appropriate computers. The mobile computing device is intended to represent various forms of mobile devices, such as personal digital assistants, cellular telephones, smartphones, and other similar computing devices. The components shown here, their connections and relationships, and their functions, are meant to be exemplary only, and are not meant to limit implementations of the inventions described and/or claimed in this document.

The computing device 500 includes a processor 502, a memory 504, a storage device 506, a high-speed interface 508 connecting to the memory 504 and multiple high-speed expansion ports 510, and a low-speed interface 512 connecting to a low-speed expansion port 514 and the storage device 506. Each of the processor 502, the memory 504, the storage device 506, the high-speed interface 508, the high-speed expansion ports 510, and the low-speed interface 512, are interconnected using various busses, and may be mounted on a common motherboard or in other manners as appropriate. The processor 502 can process instructions for execution within the computing device 500, including instructions stored in the memory 504 or on the storage device 506 to display graphical information for a GUI on an external input/output device, such as a display 516 coupled to the high-speed interface 508. In other implementations, multiple processors and/or multiple buses may be used, as appropriate, along with multiple memories and types of memory. Also, multiple computing devices may be connected, with each device providing portions of the necessary operations (e.g., as a server bank, a group of blade servers, or a multi-processor system).

The memory 504 stores information within the computing device 500. In some implementations, the memory 504 is a volatile memory unit or units. In some implementations, the memory 504 is a non-volatile memory unit or units. The memory 504 may also be another form of computer-readable medium, such as a magnetic or optical disk.

The storage device 506 is capable of providing mass storage for the computing device 500. In some implementations, the storage device 506 may be or contain a computer-readable medium, such as a floppy disk device, a hard disk device, an optical disk device, or a tape device, a flash memory or other similar solid state memory device, or an array of devices, including devices in a storage area network or other configurations.

A computer program product can be tangibly embodied in an information carrier. The computer program product may contain instructions that, when executed, perform one or more methods, such as those described above. The computer program product can also be tangibly embodied in a computer- or machine-readable medium, such as the memory 504, the storage device 506, or memory on the processor 502.

The high-speed interface 508 manages bandwidth-intensive operations for the computing device 500, while the low-speed interface 512 manages lower bandwidth-intensive operations. Such allocation of functions is exemplary only. In some implementations, the high-speed interface 508 is coupled to the memory 504, the display 516 (e.g., through a graphics processor or accelerator), and to the high-speed expansion ports 510, which may accept various expansion cards (not shown). In the implementation, the low-speed interface 512 is coupled to the storage device 506 and the low-speed expansion port 514. The low-speed expansion port 514, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 500 may be implemented in a number of different forms, as shown in the figure. For example, it may be implemented as a standard server 518, or multiple times in a group of such servers. In addition, it may be implemented in a personal computer such as a laptop computer 520. It may also be implemented as part of a rack server system 522. Alternatively, components from the computing device 500 may be combined with other components in a mobile device (not shown), such as a mobile computing device 550. Each of such devices may contain one or more of the computing device 500 and the mobile computing device 550, and an entire system may be made up of multiple computing devices communicating with each other.

The mobile computing device 550 includes a processor 552, a memory 564, an input/output device such as a display 554, a communication interface 566, and a transceiver 568, among other components. The mobile computing device 550 may also be provided with a storage device, such as a microdrive or other device, to provide additional storage. Each of the processor 552, the memory 564, the display 554, the communication interface 566, and the transceiver 568, are interconnected using various buses, and several of the components may be mounted on a common motherboard or in other manners as appropriate.

The processor 552 can execute instructions within the mobile computing device 550, including instructions stored in the memory 564. The processor 552 may be implemented as a chipset of chips that include separate and multiple analog and digital processors. The processor 552 may provide, for example, for coordination of the other components of the mobile computing device 550, such as control of user interfaces, applications run by the mobile computing device 550, and wireless communication by the mobile computing device 550.

The processor 552 may communicate with a user through a control interface 558 and a display interface 556 coupled to the display 554. The display 554 may be, for example, a TFT (Thin-Film-Transistor Liquid Crystal Display) display or an OLED (Organic Light Emitting Diode) display, or other appropriate display technology. The display interface 556 may comprise appropriate circuitry for driving the display 554 to present graphical and other information to a user. The control interface 558 may receive commands from a user and convert them for submission to the processor 552. In addition, an external interface 562 may provide communication with the processor 552, so as to enable near area communication of the mobile computing device 550 with other devices. The external interface 562 may provide, for example, for wired communication in some implementations, or for wireless communication in other implementations, and multiple interfaces may also be used.

The memory 564 stores information within the mobile computing device 550. The memory 564 can be implemented as one or more of a computer-readable medium or media, a volatile memory unit or units, or a non-volatile memory unit or units. The memory 564 may include, for example, flash memory and/or NVRAM memory (non-volatile random access memory).

An expansion memory 574 may also be provided and connected to the mobile computing device 550 through an expansion interface 572, which may include, for example, a SIMM (Single In Line Memory Module) card interface. The expansion memory 574 may provide extra storage space for the mobile computing device 550, or may also store applications or other information for the mobile computing device 550. Specifically, the expansion memory 574 may include instructions to carry out or supplement the processes described above, and may include secure information also. Thus, for example, the expansion memory 574 may be provide as a security module for the mobile computing device 550, and may be programmed with instructions that permit secure use of the mobile computing device 550. In addition, secure applications may be provided via the SIMM cards, along with additional information, such as placing identifying information on the SIMM card in a secure manner.

In some implementations, a computer program product is tangibly embodied in an information carrier. The computer program product contains instructions that, when executed, perform one or more methods, such as those described above. The computer program product can be a computer- or machine-readable medium, such as the memory 564, the expansion memory 574, or memory on the processor 552. In some implementations, the computer program product can be received in a propagated signal, for example, over the transceiver 568 or the external interface 562 and stored in the computer- or machine-readable medium.

The mobile computing device 550 may communicate wirelessly through the communication interface 566, which may include digital signal processing circuitry where necessary. The communication interface 566 may provide for communications under various modes or protocols, such as GSM voice calls (Global System for Mobile communications), SMS (Short Message Service), EMS (Enhanced Messaging Service), or MMS messaging (Multimedia Messaging Service), CDMA (code division multiple access), TDMA (time division multiple access), PDC (Personal Digital Cellular), WCDMA (Wideband Code Division Multiple Access), CDMA2000, or GPRS (General Packet Radio Service), among others. Such communication may occur, for example, through the transceiver 568 using a radio-frequency. In addition, short-range communication may occur, such as using a Bluetooth, Wi-Fi, or other such transceiver (not shown). In addition, a GPS (Global Positioning System) receiver module 570 may provide additional navigation- and location-related wireless data to the mobile computing device 550, which may be used as appropriate by applications running on the mobile computing device 550.

The mobile computing device 550 may also communicate audibly using an audio codec 560, which may receive spoken information from a user and convert it to usable digital information. The audio codec 560 may likewise generate audible sound for a user, such as through a speaker, e.g., in a handset of the mobile computing device 550. Such sound may include sound from voice telephone calls, may include recorded sound (e.g., voice messages, music files, etc.) and may also include sound generated by applications operating on the mobile computing device 550.

The mobile computing device 550 may be implemented in a number of different forms, as shown in the figure. For example, it may be implemented as a cellular telephone 580. It may also be implemented as part of a smartphone 582, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

It is understood that any specific order or hierarchy of steps in the processes disclosed is an illustration of example approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components illustrated above should not be understood as requiring such separation, and it should be understood that the described program components and systems can generally be integrated together in a single software product or packaged into multiple software products.

Various modifications to these aspects will be readily apparent, and the generic principles defined herein may be applied to other aspects. Thus, the claims are not intended to be limited to the aspects shown herein, but is to be accorded the full scope consistent with the language claims, where reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

A phrase, for example, an "aspect" does not imply that the aspect is essential to the subject technology or that the aspect applies to all configurations of the subject technology. A disclosure relating to an aspect may apply to all configurations, or one or more configurations. A phrase, for example, an aspect may refer to one or more aspects and vice versa. A phrase, for example, a "configuration" does not imply that such configuration is essential to the subject technology or that such configuration applies to all configurations of the subject technology. A disclosure relating to a configuration may apply to all configurations, or one or more configurations. A phrase, for example, a configuration may refer to one or more configurations and vice versa.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A computer-implemented method for providing a graphical user interface for enlarging a portion of an image displayed by a web browser, the method comprising:

providing a first image from a server system to a client computing device for display;

providing a second image from the server system to the client computing device for display; and providing instructions from the server system to the client computing device for displaying a portion of the second image as a plurality of rectangular shapes, and for displaying a window having an opaque curved border that overlaps a plurality of edges of the rectangular shapes to depict the portion of the second image within the window as having a curved perimeter, wherein the portion of the second image displayed within the window corresponds to a position of the window over the first image.

2. The method of claim 1, wherein the first image and the second image are maps, and wherein the first image is a different type of map than the second image.

3. The method of claim 1, wherein the second image has a different magnification than the first image.

4. The method of claim 1, wherein the instructions are processed by a web browser application at the client computing device; and wherein the first image, the window, and the portion of the second image are displayed within a user interface of the web browser application.

5. A system for providing a graphical user interface for enlarging a portion of an image displayed by a web browser, the system comprising:

one or more processors;

a memory comprising instructions which, when executed by the one or more processors, cause the one or more processors to:

provide a first image from a server system to a client computing device for display;

receive user input from the client computing device, wherein the user input provides information about a position of a window corresponding to a portion of the first image; and provide instructions from the server system to the client computing device for displaying as a plurality of rectangular shapes, and for displaying a window having an opaque curved border that overlaps a plurality of edges of the rectangular shapes to depict the portion of a second image within the window over the first image as having a curved perimeter, wherein the instructions comprise of displaying one or more rectangular shapes to approximate a curved shape.

6. The system of claim 5, wherein the instructions are such that they can be processed by a browser running on a client computing device.

7. The system of claim 5, wherein the first image and the second image are maps, wherein the first image is a different type of map than the second image.

8. The system of claim 5, wherein the first image has a different magnification than the second image.

9. A non-transitory machine-readable medium comprising instructions stored therein, which when executed by a machine, cause the machine to perform operations comprising:

providing a first image from a server system to a client computing device for display;

providing a second image from the server system to the client computing device for display; and providing instructions from the server system to the client computing device for displaying a portion of the second image as a plurality of rectangular shapes, and for displaying a window having an opaque curved border that overlaps a plurality of edges of the rectangular shapes to depict the portion of the second image within the window as having a curved perimeter, wherein the portion of the second image displayed within the window corresponds to a position of the window over the first image.

10. The non-transitory machine-readable medium of claim 9, wherein the instructions are such that they can be processed by a browser running on the client computing device.

11. The non-transitory machine-readable medium of claim 9, wherein the first image and the second image are maps, wherein the first image is a different type of map than the second image.

12. The non-transitory machine-readable medium of claim 9, wherein the first image has a different magnification than the second image.

* * * * *